United States Patent [19]

Schmid

[11] 4,243,377

[45] Jan. 6, 1981

[54] FLUID FLOW CONTROL VALVE

[76] Inventor: Paul Schmid, 71 Lakeview Dr., Milford, Conn. 06460

[21] Appl. No.: 890,379

[22] Filed: Mar. 27, 1978

[51] Int. Cl.[3] ..... F23D 13/04

[52] U.S. Cl. ..... 431/344; 431/277

[58] Field of Search ..... 431/344, 276, 277, 254, 431/255, 150, 142, 130, 131; 222/3

[56] References Cited

U.S. PATENT DOCUMENTS

| | | | |
|---|---|---|---|
| 3,161,033 | 12/1964 | Iketani | 431/150 |
| 3,423,160 | 1/1969 | Genoud | 431/276 |
| 3,590,591 | 7/1971 | Genoud | 431/344 |
| 3,961,876 | 6/1976 | Chernock | 431/344 |
| 4,036,579 | 7/1977 | Marynissen | 431/277 |

*Primary Examiner*—Carroll B. Dority, Jr.
*Assistant Examiner*—Lee E. Barrett
*Attorney, Agent, or Firm*—DeLio and Montgomery

[57] ABSTRACT

A fluid flow control valve for use in liquified gas-filled lighters or the like to limit the maximum rate of flow, and corresponding height of flame, as a function of the degree of compression of a filter mass through which the gas must flow, including simple means for varying the degree of compression and a stop to establish a predetermined maximum flow rate.

8 Claims, 7 Drawing Figures

FLUID FLOW CONTROL VALVE

This invention relates to a gas flow control valve for use in liquified gas-filled lighters or the like to limit the maximum rate of flow, and corresponding height of flame, as a function of the degree of compression of a filter mass through which the gas must flow, including simple means for varying the degree of compression and a stop to establish a predetermined maximum flow rate.

Lighters which are charged with a liquified gas, such as butane, are normally operated by means of a button or lever which, when depressed, opens a valve to permit escape of the gas while a spark is simultaneously supplied to ignite the gas. The valve must include elements which perform two functions, namely, obturating (opening-closing) and throttling or metering, and the latter function must be adjustable to enable the user to regulate the height of the flame with due regard for varying gas pressure. The two functions just referred to could be performed by a single adjustable obturating valve, but this is considered to be unsafe, and is also inconvenient.

The present invention is concerned with the provision of an improved throttling or metering assembly, adapted for use with various forms of obturating valves in various forms of lighters.

A known device which deals with the same problem is shown and described in Iketani U.S. Pat. No. 3,161,033, Dec. 15, 1964, wherein a resilient block rests in the bottom of a cup-shaped stationary member and is deformed to varying degrees by screwing a movable member down or up to cause grooves or slots formed in or adjacent to the block to be varied cross-sectionally, the grooves or slots constituting portions of the escape path for the fluid. In each instance the parts require precise molding, forming or machining, and the resilient block, being constantly deformed, may exhibit deterioration from fatigue.

It is accordingly an object of the present invention to provide a valve assembly wherein the fluid escape path includes a compressible filter mass located in a variable volume cavity in the bottom of a cup-shaped fixed member in which is threaded a movable member containing the obturating valve.

It is another object of the invention to provide a valve assembly having means for limiting the fluid-releasing movement of the movable member.

It is a further object of the invention to provide a valve assembly wherein the surfaces of the variable volume cavity are not grooved or slotted and the filter mass is likewise not grooved or slotted.

It is yet another object of the invention to provide a valve assembly having fewer and simpler parts than the valves heretofore available, and which can be very easily made and assembled.

It is a still further object of the invention to provide a valve assembly which includes certain improvements in the form, construction and arrangement of the several parts whereby the above-named and other objects may effectively be attained.

The invention accordingly comprises the features of constuction, combinations of elements and arrangements of parts which will be exemplified in the constructions hereinafter set forth, and the scope of the invention will be indicated in the claims.

A practical embodiment of the invention is shown in the accompanying drawing wherein.

Figure 1:
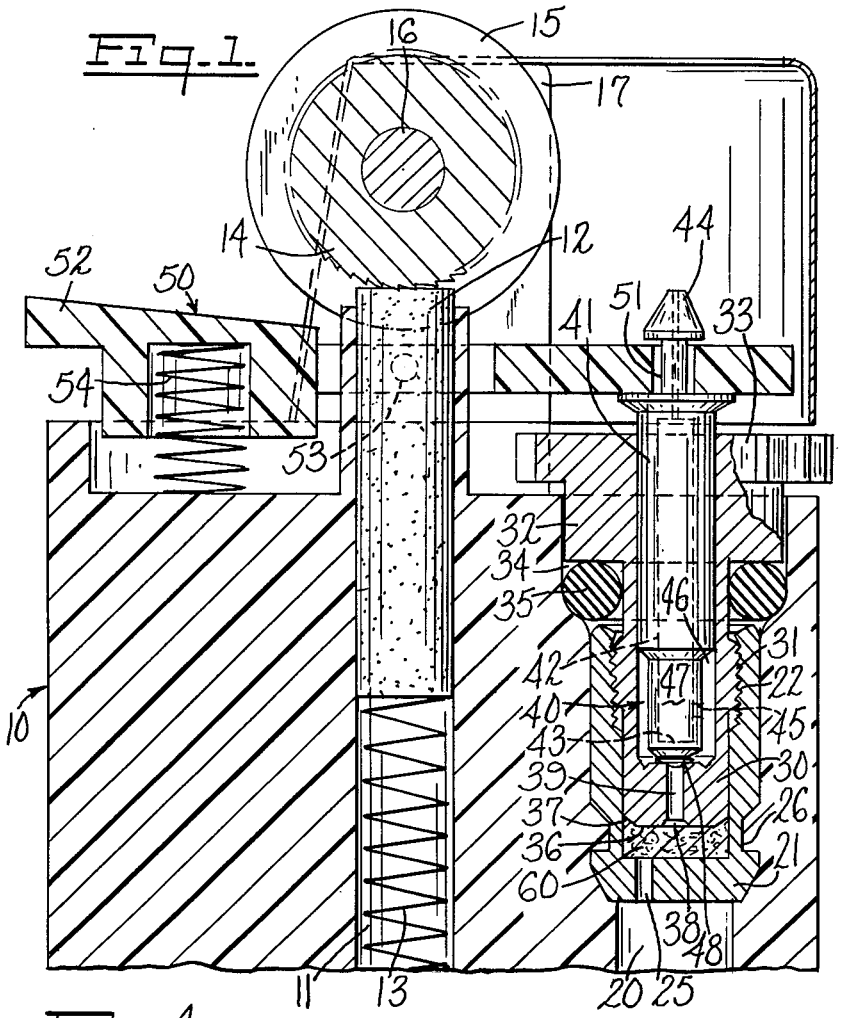
FIG. 1 represents a detail vertical section through the upper portion of a typical small lighter, showing the valve assembly and associated parts.

Referring to the drawing, the upper portion of a lighter body is represented at 10, the body having a socket 11 to receive the flint 12 and the spring 13 which biases the flint toward the sparking wheel 14. A pair of knurled thumb wheels 15 flank the sparking wheel, being carried on an axle 16 between posts 17 on the top of the lighter, in a conventional manner.

The valve assembly is located in the enlarged outer portion of the passage 20 which extends upward from the liquified gas reservoir (not shown) within the body 10. The valve base 21 is a cup-shaped element having a generally cylindrical interior and flat bottom, a portion 22 near the upper end being threaded and the upper rim being divided, by slots 23, into segments 24 for a purpose described below. The bottom wall of the base 21 is bored at 25 at a point offset from the center to provide a fluid passage from the reservoir to the inside of the valve. The base is preferably provided with an annular groove 26 or the like to permit molding the base securely into the walls of the passage 20.

Figure 2:
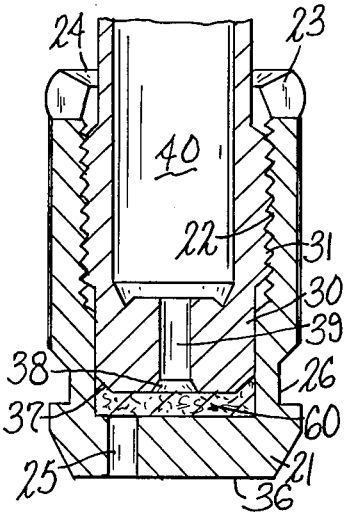
FIG. 2 represents a detail section, on a larger scale, of the lower portion of the fluid flow control valve.
Figure 3:
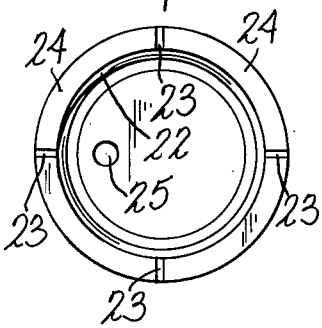
FIG. 3 represents a top plan view of the valve base.

The relatively movable element of the throttling or metering valve, as distinguished from the obturating valve, consists of the lower "piston" portion 30 which is cylindrical and has a close sliding fit in the cylindrical interior of the base 21, a threaded portion 31 engaged with the threaded portion 22, an enlarged head 32 and a knurled adjusting wheel 33. An annular recess 34, between the threaded portion and the head, is provided with an O-ring 35 which seals the space between the piston 30 and the adjacent wall of the lighter body. The bottom surface 36 of the piston 30 is shown in FIGS. 1 and 2 as having a flat annular land between a peripheral beveled surface 37 and an inner beveled surface 38, the latter forming the lower end of the gas vent passage 39 which extends axially through the bottom wall of the piston portion 30.

The movable element 30, 31, 32, 33 is provided with a cylindrical bore 40 within which slides the piston 41 of the obturating valve, this (second) piston being traversed by the axial passage 42 having a closed bottom 43, a nozzle top 44 and a lateral inlet vent 45 connecting the passage 42 with the space 46 between the reduced diameter lower end 47 of the second piston and the wall of the bore 40. The bottom 48 of the lower end 47 is adapted to seal tightly against the wall of the vent passage 39, as shown in FIG. 1.

The second piston 41 is actuated by the trigger lever 50 which extends across the top of the lighter, engaging the piston as shown at 51, with the thumb piece 52 at theopposite end, pivot point 53 in the middle and compression spring 54 beneath the thumb piece serving to bias the piston downward to its vent obturating position.

Adjustable throttling or metering of the fluid flow is effected with the aid of a filter pad or mass 60 of felted, fibrous, foraminous, permeable material, located within the cup-shaped base 21 beneath the bottom surface 36 of the first piston 30. A wide variety of materials may be used for the filter mass including felted natural or synthetic fibers of vegetable or mineral origin, porous solids, and combinations of such materials. The major requirements are coherency, so that portions will not become separated in the passages 25 or 39; compressability, so that the fluid permeability can be varied as required; physical and chemical inertness with respect to the fluid to be metered, and resiliency, i.e., no tendency to become set in any given state of density. When a filter pad or mass 60 of such material has been placed within the base 21, the first piston 30 is introduced and screwed down sufficiently to cause some initial compression of the mass and to bring the threaded portion 31 below the zone of the slots 23 and segments 24, the latter being thereupon crimped inward (FIGS. 1 and 2) to create a positive stop which limits the unscrewing movement of the piston 30. When the assembly just referred to, with the O-ring added, is installed in a lighter body 10, as shown in FIG. 1, and the second piston 41, with its operating trigger, is added, the flow of fluid becomes subject to two essential controls. The space at the bottom 48 of the piston 41 is either wide open or tight shut (obturated) in response to actuation of the trigger. When it is shut, the throttling effect of the filter mass 60 is not functional, but when it is open such throttling effect limits the fluid flow as a function of the degree of compression of the mass which can be instantly varied by means of the adjusting wheel 33. Such adjustment serves to create a higher or lower flame at a given constant fluid pressure or a constant height flame with varying fluid pressure. The maximum flame height is established by the positive stop resulting from the crimping of the segments 24 and the diameter of the bored hole 25.

Figure 4:
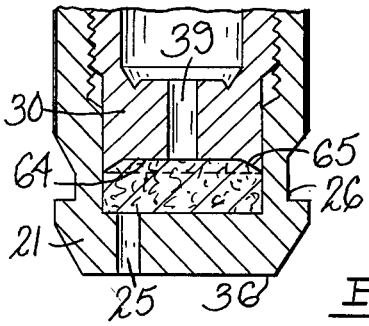
FIGS. 4, 5, 6 and 7 represent detail modifications in the form of the adjustable valve member and the filter mass.
Figure 5:
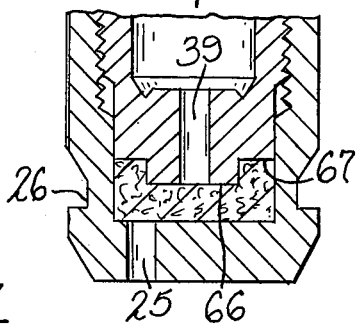
Figure 6:
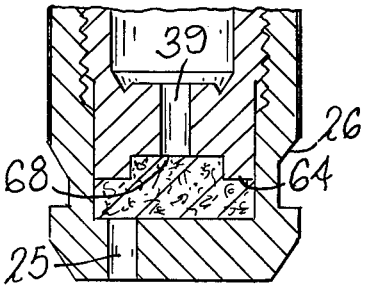
Figure 7:
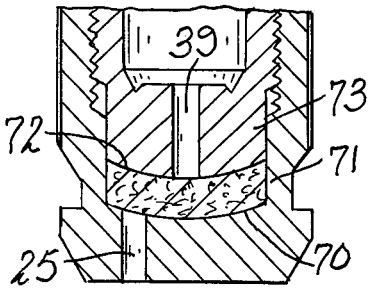

Some variations which may be made in the shape of the chamber containing the filter mass, are illustrated in FIGS. 4, 5, 6 and 7. In FIGS. 4, 5 and 6 the bottom of the chamber is flat, as in FIGS. 1 and 2, but in FIG. 4 the bottom surface 64 of the first piston is bounded peripherally by a beveled ridge 65; in FIG. 5 the bottom surface 66 of the first piston is bounded by an annular rabbett 67; and in FIG. 6 the bottom 68 of the first piston is bounded peripherally by an annular shoulder 69. In each case the filter mass may be installed as a pad of uniform thickness or may be preshaped to some extent to match the shape of the cavity. In FIG. 7 the bottom wall 70 of the valve base 71 has the shape of a spherical segment and the bottom surface 72 of the first piston 73 is complementarily formed to leave a chamber having a dished profile to receive a filter mass having uniform thickness. Other configurations or combinations, thereof could be used, if desired, but forms which call for a minimum of special shaping are preferred. The piston bottom ends shown in FIGS. 1, 5 and 7 may be termed "convexly profiled," while those shown in FIGS. 4 and 6 may be termed "concavely profiled."

Since the filter mass rests directly against the adjacent surfaces of the cup-shaped base and the adjustable first piston, no washers or the like are required as in some previously known lighters. The second piston is held in closed position by means of the spring-biased trigger so that no interior spring is needed. The principal mechanical elements are of simple form, can be made very rapidly on known forming machines using inexpensive materials and can be assembled in fewer steps than many otherwise comparable devices, resulting in a very economical operation.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What I claim is:

1. A fluid flow control device for use in a liquified gas lighter having a body containing a fuel reservoir and a fuel supply passage, comprising:

a cup-shaped stationary member fixed in said fuel supply passage and provided internally with a circular bottom, a fuel vent passage located eccentrically in said circular bottom, a lower cylindrical wall portion and an upper threaded zone, said fuel vent passage being out of contact with said cylindrical wall portion, a first piston having a bottom end, a lower cylindrical portion slidable in the lower cylindrical portion of the stationary member, a threaded portion engaged with said threaded zone and a manually accessible upper portion, whereby the piston may be rotated to adjust the distance between its bottom end and the circular bottom of the stationary member, said first piston being provided with an axially disposed cylindrical chamber and an axially disposed passage traversing the bottom of the piston to connect the cylindrical chamber with a space between said bottom end and circular bottom, a second piston slidable in said cylindrical chamber and having a burner nozzle at its upper end, a longitudinal passage leading to said nozzle and means at its lower end for selectively obturating the passage in the bottom of the first piston, said longitudinal passage being in fluid communication with said cylindrical chamber, and a compressible filter mass substantially filling the space between the first piston bottom end and the circular bottom of the stationary member and resting directly against said bottom end and circular bottom.

2. A fluid flow control device according to claim 1 wherein said circular bottom is flat.

3. A fluid flow control device according to claim 1 wherein said circular bottom is concavely dished.

4. A fluid flow control device according to claim 1 wherein said piston bottom end is convexly profiled.

5. A fluid flow control device according to claim 1 wherein said piston bottom end is concavely profiled.

6. A fluid flow control device according to claim 1 wherein the first piston is provided with an annular recess between the threaded portion and the upper portion, an O-ring being fitted in said recess to seal against a surface of the lighter body.

7. A fluid flow control device according to claim 1 wherein the upper edge of the stationary member lies above the upper limit of the threaded portion of the first piston and said upper edge is crimped radially inward to limit the upward movement of said first piston.

8. A fluid flow control device for use in a liquified gas lighter having a body containing a fuel reservoir and a fuel supply passage, comprising:

a cup-shaped stationary member fixed in said fuel supply passage and provided internally with a circular bottom, a fuel vent passage located eccentrically in said circular bottom, a lower cylindrical wall portion and an upper threaded zone, a first piston having a bottom end, a lower cylindrical portion slidable in the lower cylindrical portion of the stationary member, a threaded portion engaged with said threaded zone and a manually accessible upper portion, whereby the piston may be rotated to adjust the distance between its bottom end and the circular bottom of the stationary member, the upper edge of the stationary member lying above the upper limit of the threaded portion of the first piston and said upper edge being crimped radially inward to limit the upward movement of said first piston, said first piston being provided with an axially disposed cylindrical chamber and an axially disposed passage traversing the bottom of the piston to connect the cylindrical chamber with a space between said bottom end and circular bottom, a second piston slidable in said cylindrical chamber and having a burner nozzle at its upper end, a longitudinal passage leading to said nozzle and means at its lower end for selectively obturating the passage in the bottom of the first piston, said longitudinal passage being in fluid communication with said cylindrical chamber, and a compressible filter mass substantially filling the space between the first piston bottom end and the circular bottom of the stationary member and resting directly against said bottom end and circular bottom.

* * * * *